US005957470A

United States Patent [19]

Powell

[11] Patent Number: 5,957,470

[45] **Date of Patent: *Sep. 28, 1999**

[54] FLEXIBLE SKATE

[76] Inventor: David A. Powell, 1254 108th Avenue NW, Minneapolis, Minn. 55433

[ * ] Notice: This patent issued on a continued prosecution application filed under 37 CFR 1.53(d), and is subject to the twenty year patent term provisions of 35 U.S.C. 154(a)(2).

[21] Appl. No.: 08/612,083

[22] Filed: Mar. 7, 1996

[51] Int. Cl.[6] ..... A63C 17/02

[52] U.S. Cl. ..... 280/11.22; 280/11.27

[58] Field of Search ..... 280/11.22, 11.23, 280/11.27, 11.28, 87.042, 11; 36/115, 125, 102, 118.2–118.9

[56] References Cited

U.S. PATENT DOCUMENTS

| | | | |
|---|---|---|---|
| 120,147 | 10/1871 | Boone . | |
| 153,946 | 8/1874 | Gregg . | |
| 211,111 | 1/1879 | Rush, Jr. . | |
| 293,299 | 2/1884 | Barney . | |
| 622,815 | 4/1899 | Lindsley . | |
| 1,603,588 | 10/1926 | Eberle . | |
| 1,702,316 | 2/1929 | Ridgers . | |
| 1,801,230 | 4/1931 | Fehre . | |
| 2,162,128 | 6/1939 | Shoemaker | 280/11.19 |
| 3,219,358 | 11/1965 | Hagner | 280/11.14 |
| 3,983,643 | 10/1976 | Schreyer et al. | 36/115 |
| 4,029,330 | 6/1977 | Runyan, Jr. | 280/87.04 |
| 4,061,348 | 12/1977 | Carter | 280/11.21 |
| 4,133,548 | 1/1979 | Smith | 280/87.04 |
| 4,161,326 | 7/1979 | Gaber | 280/87.04 |
| 4,168,076 | 9/1979 | Johnson | 280/11.2 |
| 4,843,740 | 7/1989 | Walkhoff | 36/118.9 X |
| 4,861,054 | 8/1989 | Spital | 280/221 |
| 4,915,403 | 4/1990 | Wild et al. | 280/221 |
| 4,955,149 | 9/1990 | Ottieri | 36/118.9 X |
| 5,286,043 | 2/1994 | Tkaczyk | 280/11.22 |
| 5,417,444 | 5/1995 | Chen | 280/87.042 |
| 5,427,391 | 6/1995 | Cooper | 280/11.19 |
| 5,540,455 | 7/1996 | Chambers . | |
| 5,634,648 | 6/1997 | Tonel et al. | 280/11.22 |

FOREIGN PATENT DOCUMENTS

| | | |
|---|---|---|
| 0 686 412 A2 | 12/1995 | European Pat. Off. . |
| 0 774 282 A1 | 5/1997 | European Pat. Off. . |
| 35 42 251 A1 | 6/1987 | Germany . |

*Primary Examiner*—Robert J. Oberleitner
*Assistant Examiner*—Pamela J. Lipka
*Attorney, Agent, or Firm*—James R Cwayna

[57] ABSTRACT

A skate including a boot having a toe portion, a heel portion and a base. A frame is adapted to rotatedly mount a plurality of wheels to the base of the boot. The skate also includes pivot structure for allowing the toe portion and the heel portion of the boot to pivot, flex or hinge relative to each other without interference from the frame so as to enhance the comfort level of the boot.

10 Claims, 9 Drawing Sheets

FLEXIBLE SKATE

FIELD OF THE INVENTION

The present invention relates generally to skates. Specifically, the present invention relates to in-line skates.

BACKGROUND OF THE INVENTION

In recent years, the sport of in-line skating has enjoyed a tremendous growth in popularity. With the increased popularity of in-line skating as a recreational activity, many non-skaters want to learn how to in-line skate.

A problem with in-line skating is that many beginners find it difficult to learn how to in-line skate. One reason for such difficulty is that typical in-line skates have a rigid nonflexible design. The rigid design feels uncomfortable and unnatural to novice skaters who are accustomed to foot apparel, such as shoes, that flex at the natural articulation points of the feet.

SUMMARY OF THE INVENTION

The present invention relates to a skate including a boot having a toe portion, a heel portion and a base. A frame is connected to the base of the boot. The skate includes pivot structure for allowing the toe portion and the heel portion of the boot to pivot, flex or hinge relative to each other without interference from the frame so as to enhance the comfort level of the boot. The skate preferably flexes at the metatarso-phalangeal articulations of a foot or generally along the balls of the foot. The ergonomic design of the skate approximates the flexibility and feel of a conventional shoe.

It has been determined by the inventors that such an ergonomic skate assists novice in-line skaters in learning how to in-line skate. It has also been determined by the inventors that the flexible skate design of the present invention enhances the turning and braking capabilities of the skate. It has further been determined that the skate of the present invention significantly improves a skater's ability to skate backwards by allowing the skater lift the rear wheels from the ground while maintaining contact with the front wheels.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE INVENTION

Reference will now be made in detail to exemplary embodiments of the present invention which are illustrated in the accompanying drawings. Wherever possible, the same reference numbers will be used throughout the drawings to refer to the same or like parts.

Figure 1:
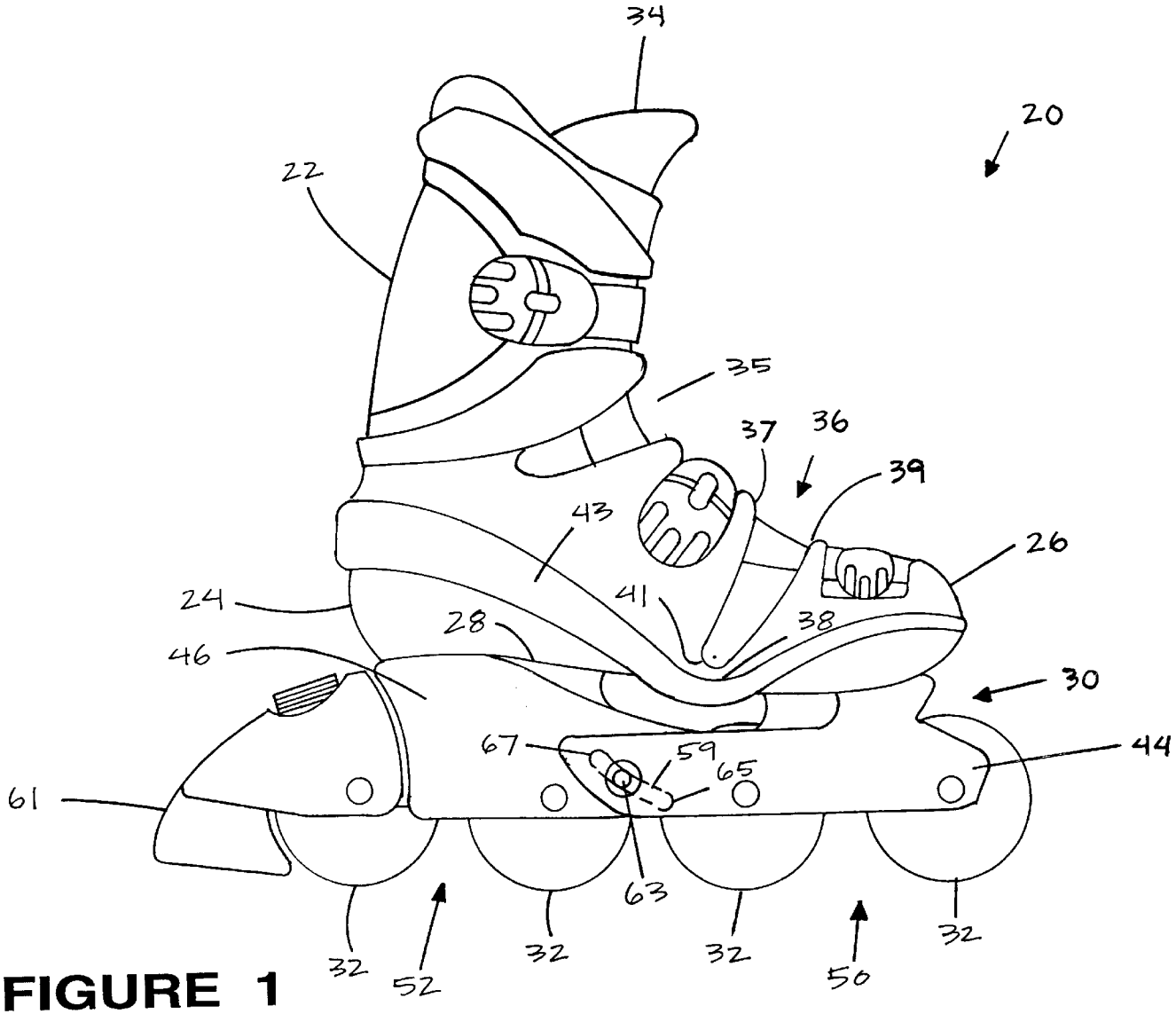
FIG. 1 is a side view of a skate constructed in accordance with the principles of the present invention.

FIG. 1 shows a skate 20 constructed in accordance with the principles of the present invention. The skate 20 includes a boot 22 having a heel portion 24, a toe portion 26 and a base 28. The skate 20 also includes a frame 30 adapted for rotatedly mounting a plurality of tandemly arranged wheels 32 along the base 28 of the boot 22. The boot 22 and the frame 30 interrelate to allow the heel and toe portions 24 and 26 of the boot 22 to flex, pivot or hinge relative to each other. It will be appreciated that the skate 20 will be used in association with a mating skate having substantially the same construction.

The boot 22 of the skate 20 is preferably constructed of a semi-rigid material capable of providing support, especially ankle support, to a wearer of the skate 20. Exemplary materials having the requisite rigidity are plastics, leather, or composites thereof. As illustrated in FIG. 1, it is preferred for the boot 22 to be constructed of molded plastic so as to form a semi-rigid outer shell. A cushioned inner liner 34 is preferably inserted within the outer shell and functions to increase the comfort of the boot 22 and to provide additional foot support. The boot 22 is preferably tightly secured to a wearer's foot through the use of conventional fastening techniques such as laces, hooks, clasps or buckles. The boot 22 is shown including an optional ankle joint 35 or slot for increasing the flexibility of the boot 22 at the ankle.

The boot 22 preferably includes a first pivot structure located between the toe and heel portions 26 and 24 for allowing the semi-rigid boot 22 to flex in a manner similar to a standard shoe. A preferred first pivot structure includes a slot 36 or gap defined between a first edge 37 of the heel portion 24 and a second edge 39 of the toe portion 26. As shown in FIG. 1, the slot 36 preferably opens upward from the base 28 of the boot 22 such that the portion of the base 28 located directly below the slot 36 forms a living hinge 38 for allowing the heel and toe portions 24 and 26 of the boot 22 to flex relative to each other. The bottom of the slot 36 is preferably a curved radius 41. When the boot 22 is in a non-flexed position as shown in FIG. 1, it is preferred for the slot 36 to be wider adjacent to the top of the boot 22 than adjacent to the base 28 of the boot 22 such that the slot 36 is generally V-shaped.

Figure 4:
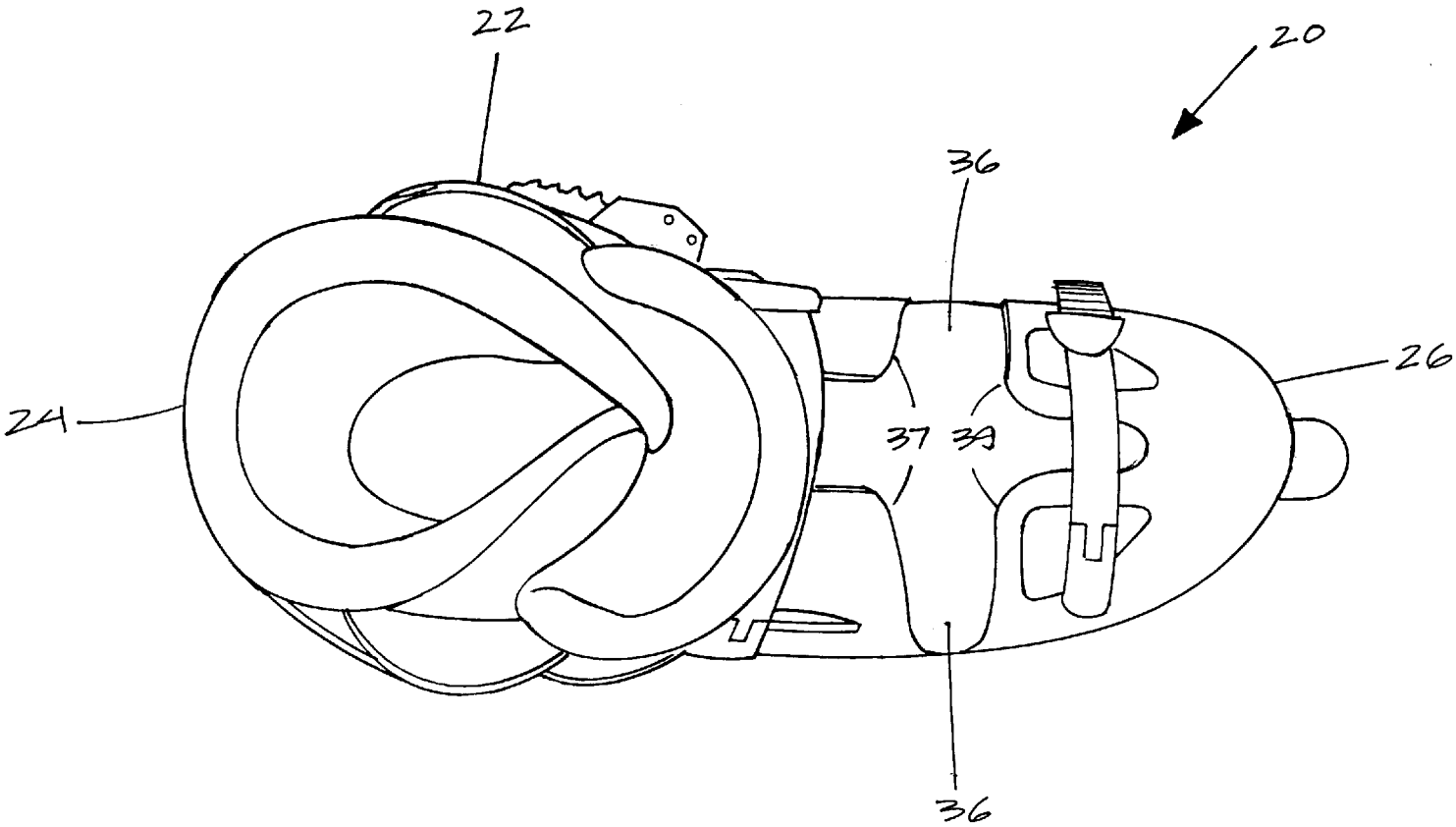
FIG. 4 is a top view of the skate of FIG. 1.

In order to maximize the comfort level of the skate 20, it is preferred for the boot 22 to flex at a location that corresponds to the natural articulation regions of a skater's foot. One natural articulation region of a foot is the metatarso-phalangeal articulations formed between the metatarsal bones and the phalanges. The metatarsal-phalangeal articulations are aligned generally along the balls of the foot. In this regard, it is preferred for the hinge 38 and the slot 36 to be located at a predetermined location so as to be adapted to align with the metatarsal-phalangeal articulations of a skater's foot. For example, FIG. 4 shows that the slot 36 extends substantially across the width of the boot 22. The slot 36 is configured to coincide with the metatarsal-phalangeal articulations of a skater's foot. It will be appreciated that the slot 36 of the boot 22 is configured to coincide with the metatarsal-phalangeal articulations of a right foot. A mating right footed boot will include a slot coincides with the metatarsal-phalangeal articulations of a left foot. It will be appreciated that the slots can be skewed slightly with respect to the length of the boot to better align with the metatarso-phalangeal articulations.

Figure 2:
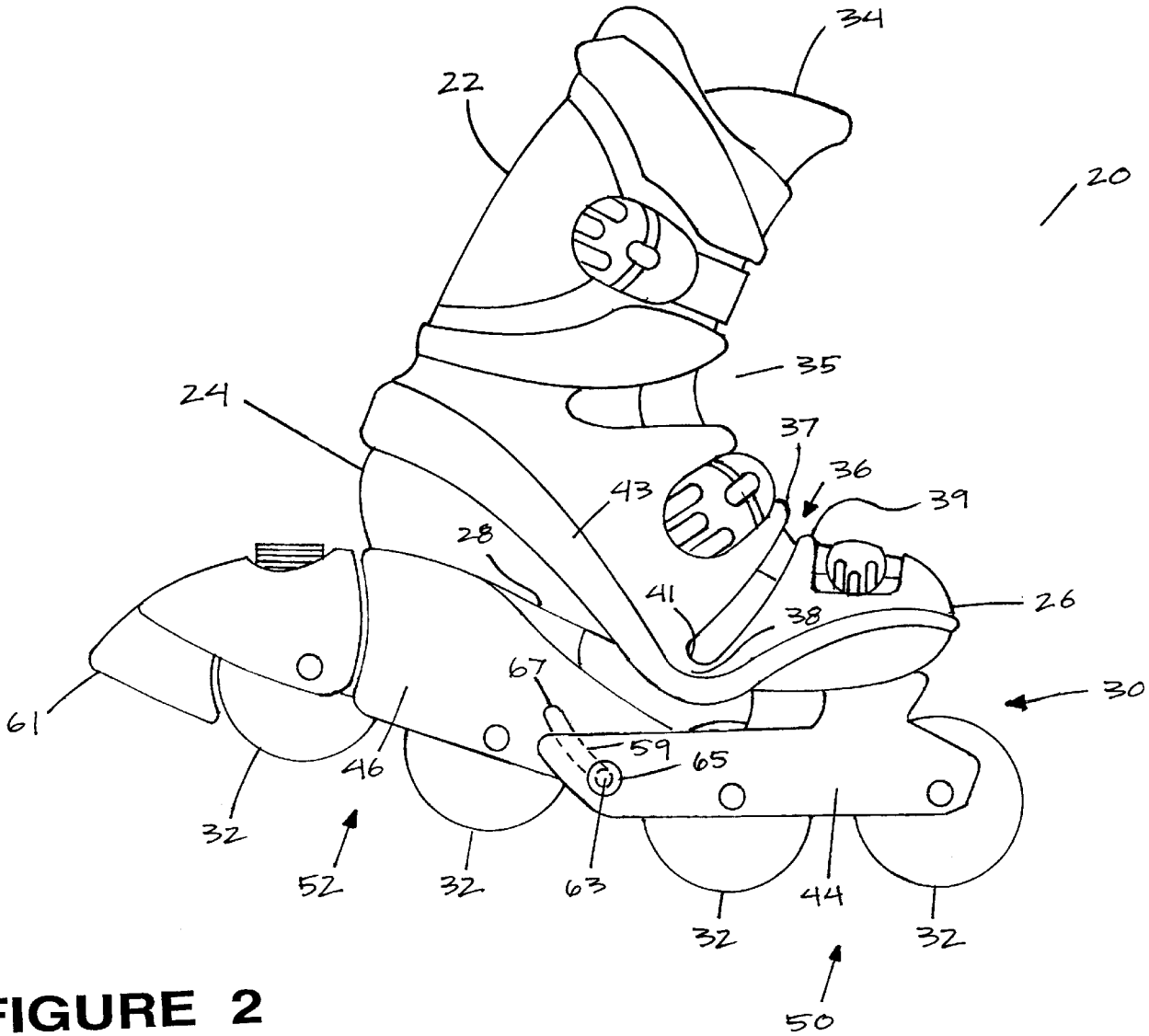
FIG. 2 is the skate of FIG. 1 shown in a compressed position such that the heel is pivoted upward with respect to the toe.

The first pivot structure of the boot 22 allows the boot 22 to flex from the non-flexed position (shown in FIG. 1) to a compressed position (shown in FIG. 2). When the boot 22 is flexed from the non-flexed position toward the compressed position, the heel and toe portions 24 and 26 of the boot 22 pivot with respect to each other about the flexible hinge 38 such that the slot 36 is compressed and becomes more narrow. In the compressed position, the heel portion 24 is preferably raised with respect to the toe portion 26. Such flexing between the heel portion 24 and the toe portion 26 is possible through the cooperation between the clearance provided by the V-shaped slot 36 and the flexibility of the flexible hinge 38.

Figure 3:
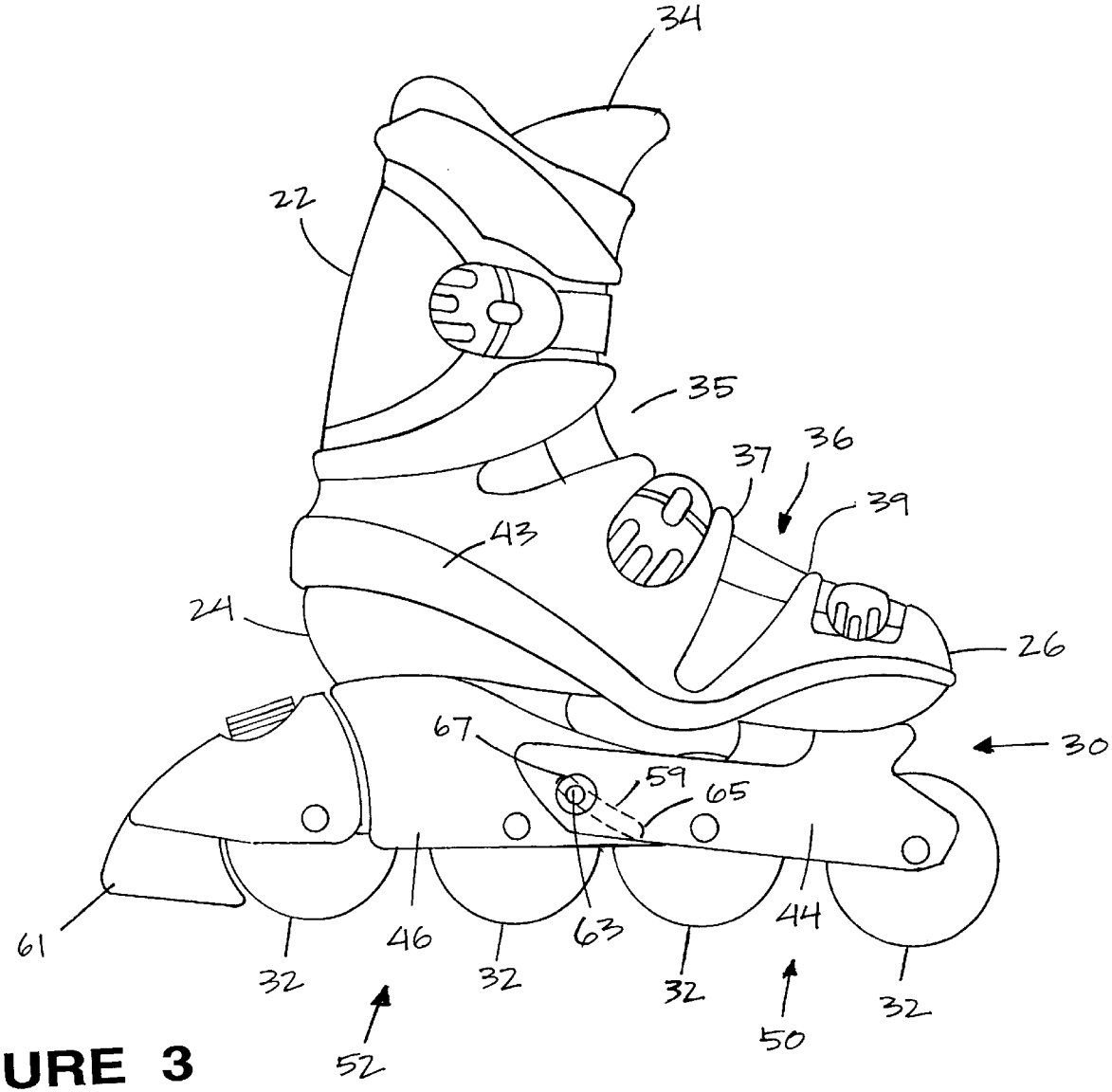
FIG. 3 shows the skate of FIG. 1 in a hyper-extended position such that the toe is pivoted down with respect to the heel.

The first pivot structure of the boot 22 also allows the boot 22 to flex from the non-flexed position (shown in FIG. 1) to a hyper-extended position (shown in FIG. 3). When the boot 22 is flexed from the non-flexed position toward the hyper-extended position, the heel and toe portions 24 and 26 of the boot 22 pivot with respect to each other about the flexible hinge 38 such that the slot 36 is expanded to allow the toe portion 26 to point generally downward.

The boot 22 also preferably includes a spring structure for biasing the heel and toe portions 24 and 26 of the boot 22 toward the non-flexed position as shown in FIG. 1. Such spring structure may be provided by the natural elasticity or resilience provided by the hinge 38 when it bends and stretches. The spring-back force provided by the hinge 38 can be altered by varying the thickness or cross-sectional area of the hinge 38. For example, integral ribbing 43 running longitudinally along the boot: 22 can be used to reinforce the hinge 38. The spring structure can also include a supplemental member affixed to the base below the hinge 38. It will be appreciated that the thickness and elasticity of the hinge 38 or the supplemental member can be varied from skate to skate in accordance with a predetermined weight of the skater. By varying the hinge 38 as described above, the skate 20 can be custom designed with predetermined flexibility and rebound that correspond to a specific skater's preference.

The frame 30 of the skate 20 is preferably adapted for rotatedly mounting the plurality of wheels 32 along the base 28 of the boot 22. The frame 30 is preferably constructed of a rigid material such as steel and preferably is fastened to the base 28 of the boot 22 by rivets or bolts. Of course, the frame 30 can be constructed of a variety of materials and can be connected to the boot 22 by a variety of other conventionally known fastening techniques.

Figure 5:
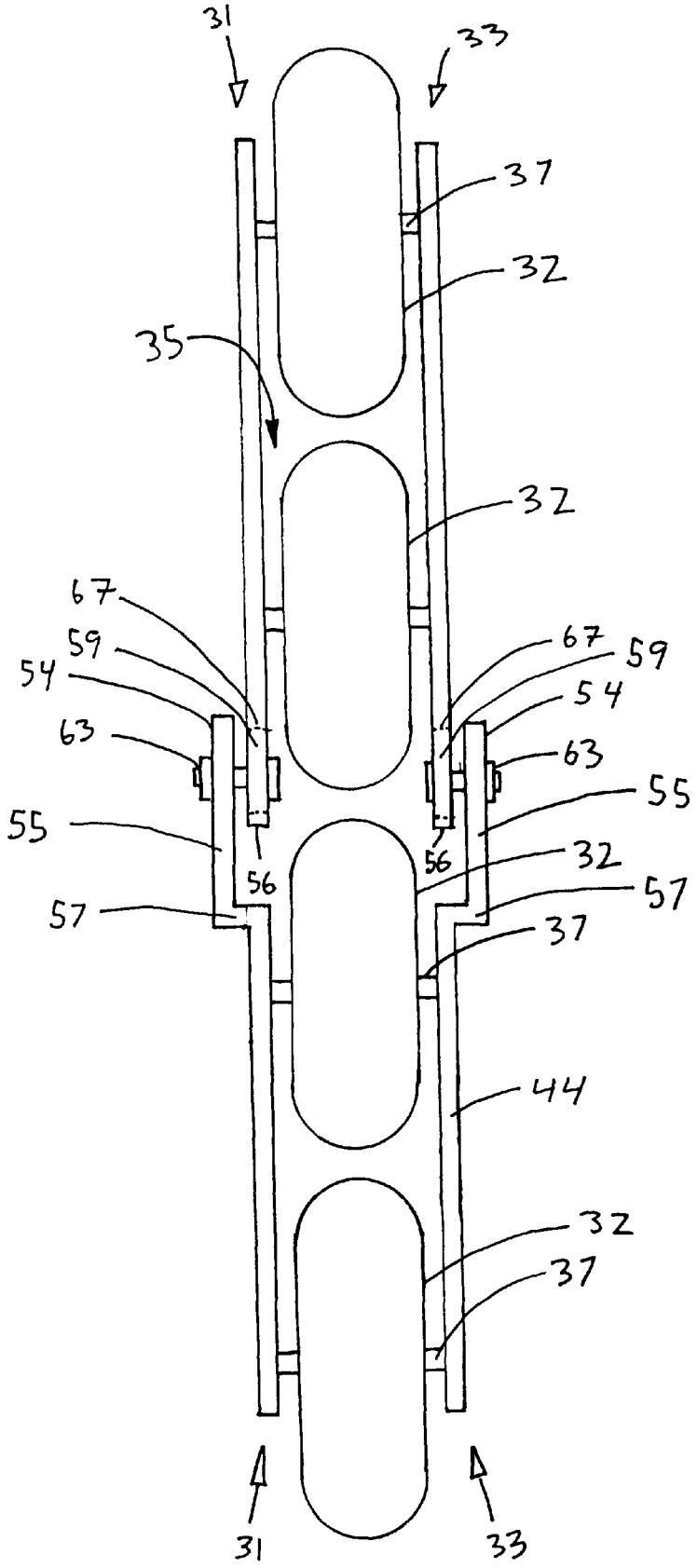
FIG. 5 is a bottom view of the skate of FIG. 1.

It will be appreciated that the wheels 32 can be connected to the frame 30 by a variety of conventionally known techniques and in variety of conventionally known configurations. However, a preferred arrangement is for the wheels 32 to be arranged tandemly in accordance with the design of conventional in-line skates. As shown in FIG. 5, a preferred arrangement of the frame 30 includes opposing first and second rails 31 and 33 that define a channel 35 thereinbetween for receiving the wheels 32. The wheels 32 preferably have central bearings including inner races that are press fit on wheel rotation shafts 37 that extend across the wheel receiving channel 35 of the frame 30 and are connected to the first and second rails 31 and 33.

The frame 30 of the skate 20 preferably includes a first portion 44 fastened to the toe portion 26 of the boot 22 and a second portion 46 fastened to the heel portion 24 of the boot 22. A first set of wheels 50 is preferably connected to the first portion 44 of the frame 30 while a second set of wheels 52 is preferably connected to the second portion 46 of the frame 30.

The frame 30 preferably also includes a second pivot structure for allowing the first and second portions 44 and 46 of the frame 30 to pivot relative to each other. As shown in FIG. 5, the first portion 44 of the frame 30 has an end 54 having opposing offset members 55 that are offset from the remainder of the first portion 44 by transverse members 57. The offset members 55 allow the end 54 of the first portion 44 to straddle and overlap an end 56 of the second portion 46 of the frame 30. Adjacent the end 56, the second portion 46 of frame 30 preferably defines opposing curved slots 59 that are best shown in FIGS. 1–3. Center lines of the curved slots 59 are preferably defined by an arc swept about an imaginary pivot axis extending generally through the hinge 38 of the boot 22.

Pivot members such as coaxially aligned pivot pins 63 preferably extend through the curved slots 59 and connect the end 54 of the first frame portion 44 to the end 56 of the second frame portion 46. The pins 63 are free to slide within the slots 59 thereby enabling the first and second portions 44 and 46 of the frame 30 to pivot relative to each other. The pin and slot configuration also allows the first and second portions 44 and 46 of the frame 30 to move longitudinally with respect to each other to accommodate movement between the heel and toe portions 44 and 46 of the boot 22. It will be appreciated that the first and second sets of wheels 51 and 52 are located on opposite sides of the curved slots 59. Additionally, the interior wheels of the skate 20 are positioned far enough apart so as to not engage one another during pivotal motion.

The first pivot structure of the boot 22 and the second pivot structure of the frame 30 cooperate to allow the heel and toe portions 24 and 26 of the boot 22 to pivot or flex relative to each other without interference from the rigid frame. FIG. 1 shows the skate 20 in the non-flexed position. In the non-flexed position, the pivot pins 63 are located in central regions of the slots 59 such that space is provided on either side of the pins 63 for allowing the pins 63 to slide in either direction. Additionally, the first and second portions 44 and 46 of the frame 30 are aligned generally parallel to other such that the ground contact points of the wheels 32 are aligned within a single plane.

FIG. 2 shows the skate 20 pivoted into the compressed position such that the first portion 44 of the frame 30 forms an oblique angle with respect to the second portion 46 of the frame 30 and the ground contact points of the first and second sets of wheels 50 and 52 are no longer located in the same plane. As the boot 22 is flexed from the non-flexed position toward the compressed position, the pins 63 are caused to slide within the slots 59 defined by the second portion 46 of the frame 30 in directions toward first ends 65 of the slots 63. The first ends 65 of the slots 63 function to limit the range of pivotal motion of the skate 20 to prevent the boot 22 from over-compressing.

FIG. 3 shows the skate 20 pivoted into the hyper-extended position such that the first portion 44 of the frame 30 forms an oblique angle with respect to the second portion 46 of the frame 30 and the ground contact points of the first and second sets of wheels 50 and 52 are no longer located in the same plane. As the boot 22 is flexed from the non-flexed position toward the hyper-extended position, the pins 63 are caused to slide within the slots 59 defined by the second portion 46 of the frame 30 in directions toward second ends 67 of the slots 63. The second ends 67 of the slots 63 function to limit the range of pivotal motion of the skate 20 to prevent the boot 22 from over-hyper-extending.

It will be appreciated that the skate 20 or its mate can be equipped with a braking mechanism such as a conventional heel brake 61. The flexibility of the skate 20, especially the ability to hyperextend the toe portion 26 with respect to the heel portion 26, enhances a skater's ability to press a heel brake against a ground surface thereby improving a skater's ability to stop.

Figure 6:
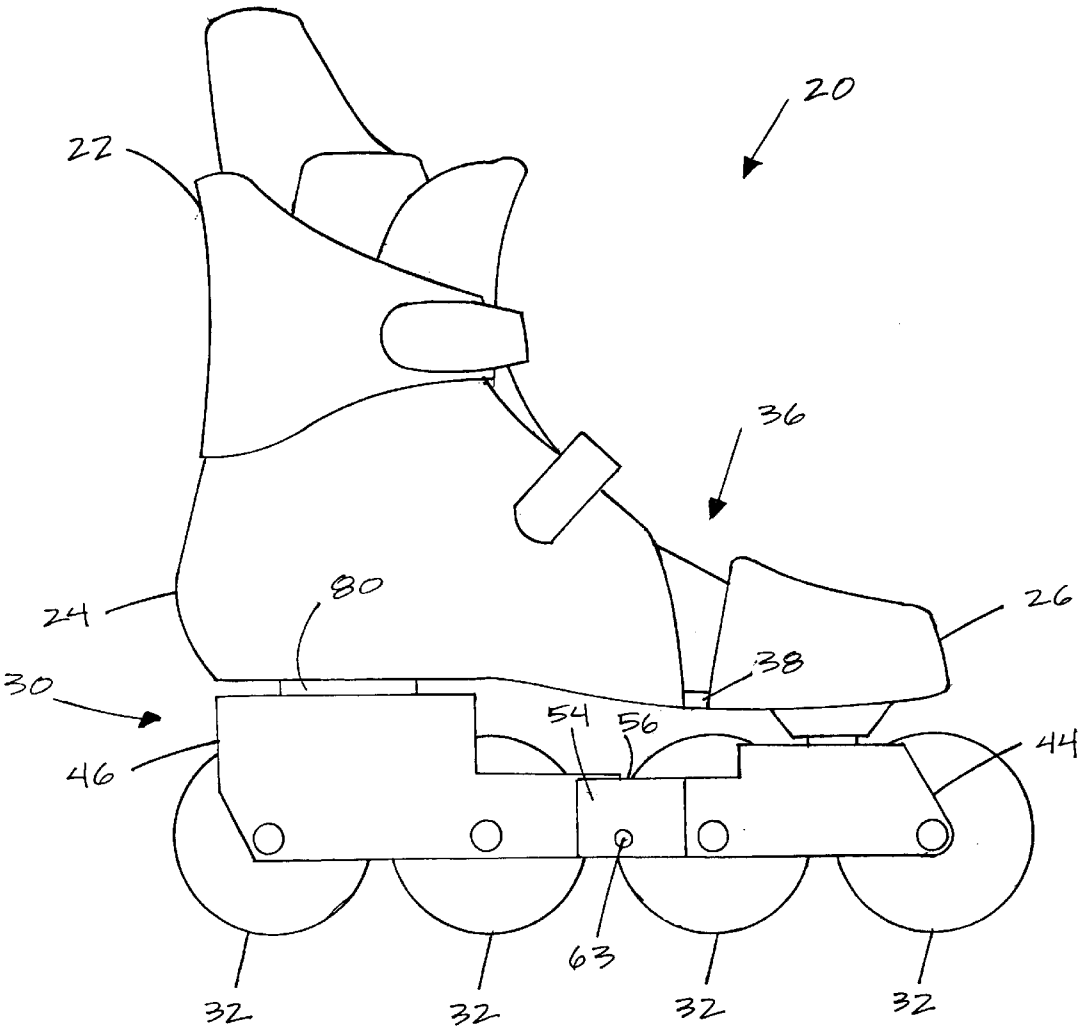
FIG. 6 is an alternative skate constructed in accordance with the principles of the present invention.
Figure 7:
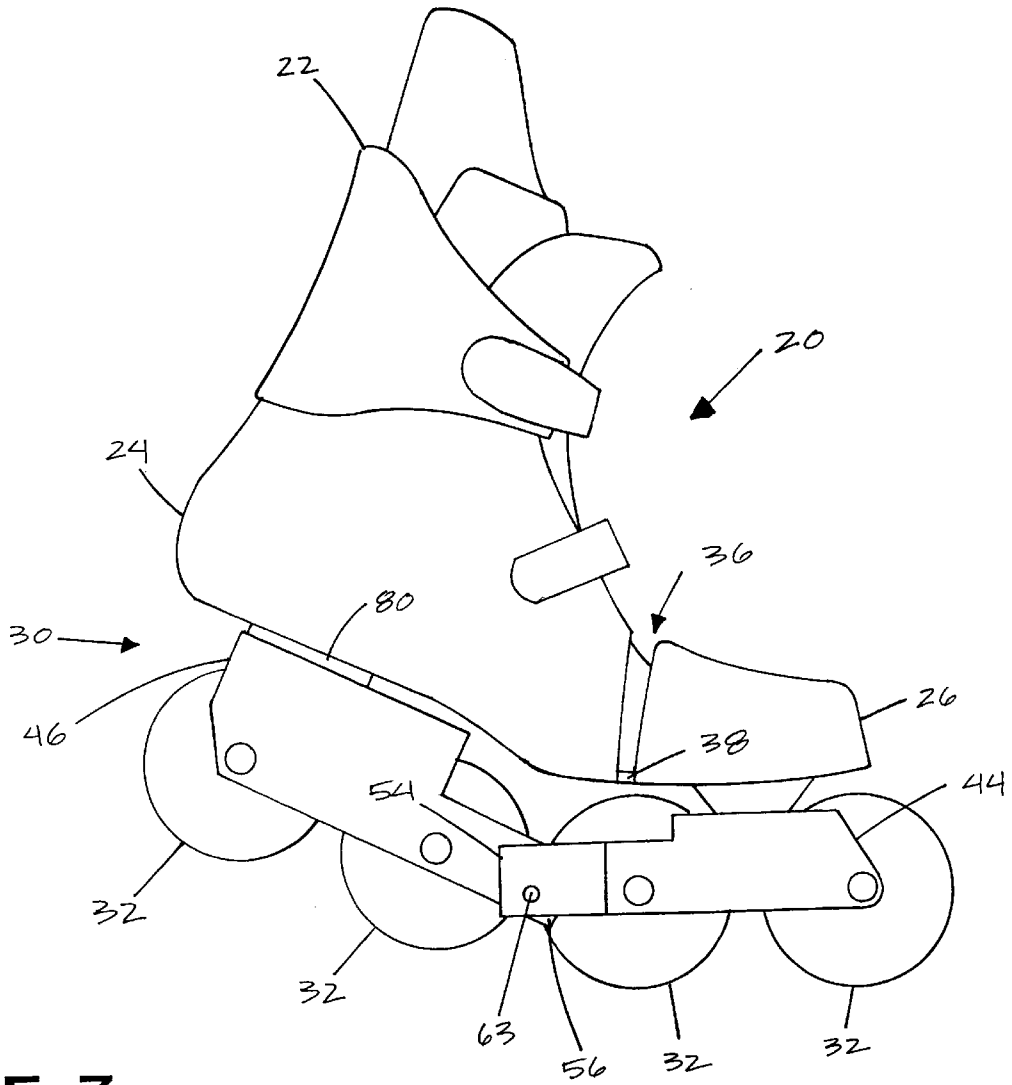
FIG. 7 shows the skate of FIG. 6 oriented in a compressed position such that the heel is pivoted upward relative to the toe.
Figure 8:
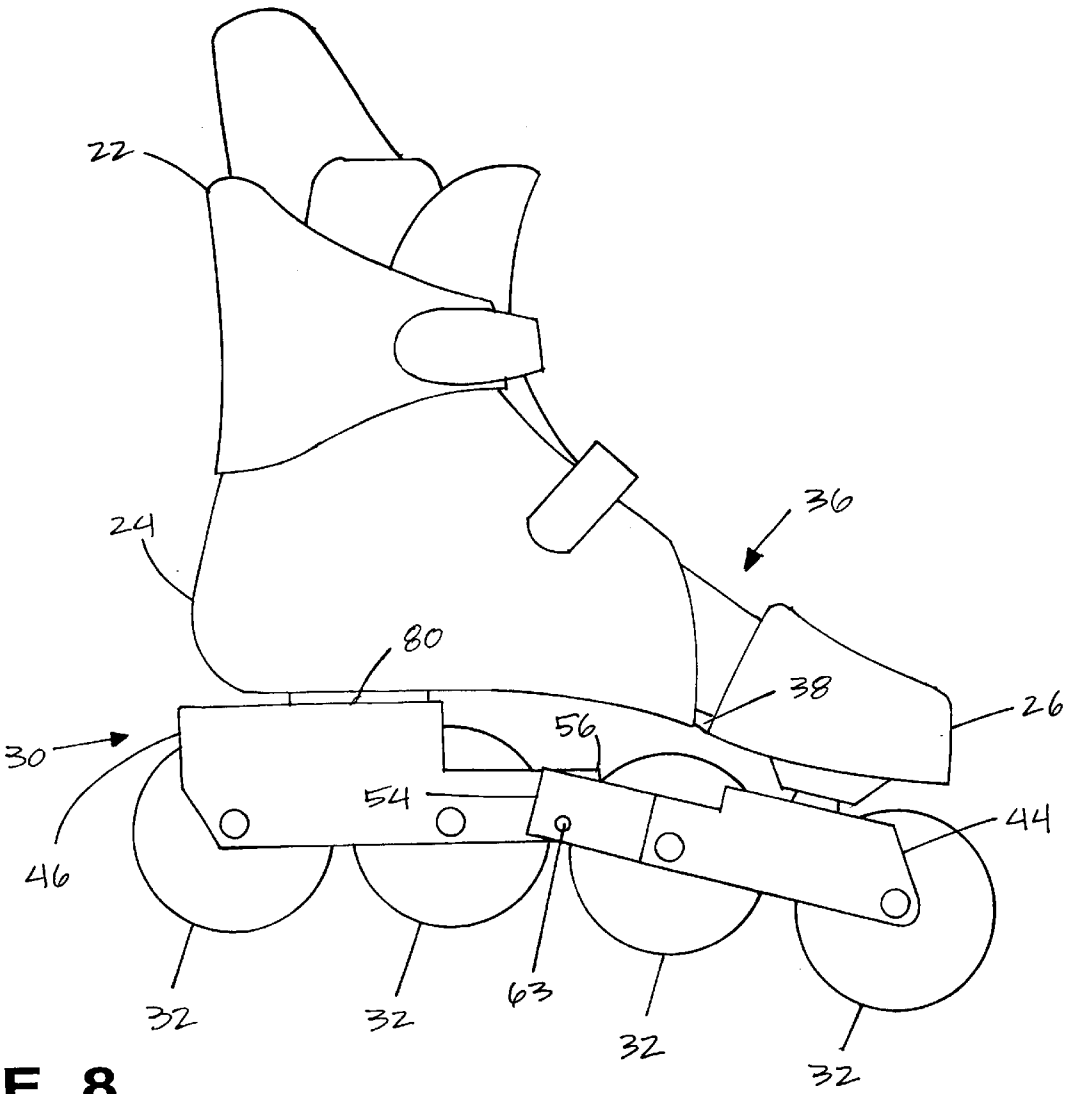
FIG. 8 shows the skate of FIG. 6 in a hyper-extended position such that the toe is pivoted downward relative to the heel.

FIGS. 6–8 show an alternative skate 20' constructed in accordance with the principles of the present invention. The skate incorporates a boot 22' having a similar construction as the boot 22 that was previously described in the specification. The skate 20' also incorporates an alternative frame 30' including an alternative second pivot structure that cooperates with a first pivot structure of the boot 20' to allow heel and toe portions 24' and 26' of the boot 22' to flex relative to one another.

Figure 9:
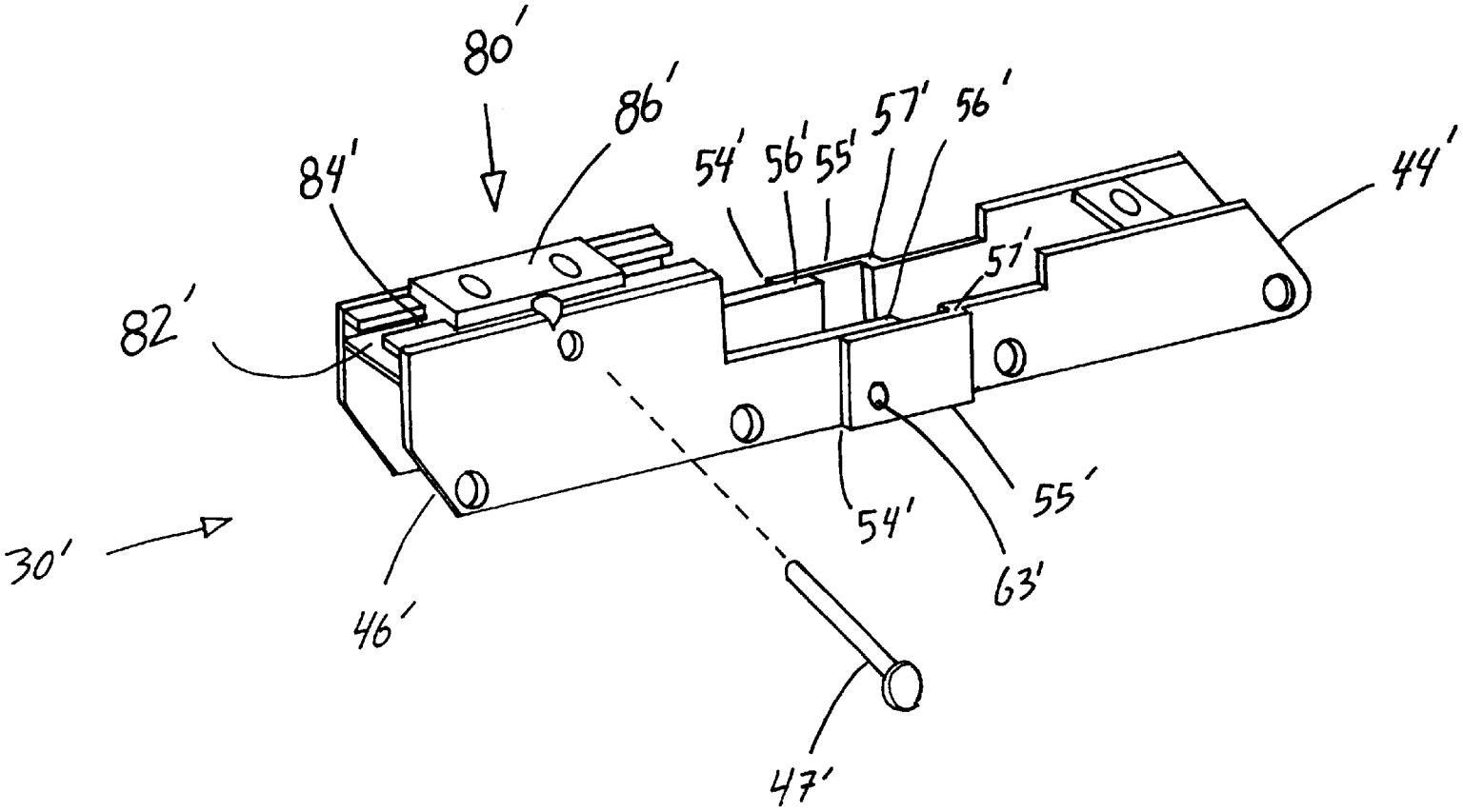
FIG. 9 is a perspective view of a track mechanism for use in association with the skate of FIG. 6.

The frame 30' includes a first portion 44' connected to the toe portion 26' of the boot 22' and a second portion 46' connected to the heel portion 24' the boot 22'. Wheels 32' are tandemly and rotatedly mounted to the frame 30' in the same manner previously described in the specification. As shown in FIG. 9, the first portion 44' of the frame 30' includes an end 54' having offset members 55' that are outwardly offset from the remainder of the first portion 44' of the frame 30' by transverse members 57'. The outwardly offset members 55' of the first frame portion 44' preferably straddle an end 56' of the second frame portion 46'. The first and second ends 54' and 56' are pivotally connected together at a pivot axis by conventional pivotal fastening techniques such as pivot pins 63', bolts or rivets. The pivot pins 63' are preferably aligned co-axially along the pivot axis of the frame 30' and are preferably pivotally received within circular openings defined by at least one of the first and second portions 44' and 46' of the frame 30'.

The pivot pins 63' allow the first and second portions 44' and 46' of the frame 30' to pivot relative to each other. However, the pivot pins 63' do not allow for longitudinal movement between first and second portions 44' and 46' of the frame 30'. Therefore, to enhance the flexibility of the skate 20' and to accomodate movement between the heel and toe portions 24' and 26' of the boot 22', the second portion 46' of the frame 30' is preferably connected to the heel portion 24' of the boot 22' through the use of a slide track mechanism 80'.

As shown in FIG. 9, the slide track mechanism 80' includes a T-shaped slot 82' located adjacent to the top of the second portion 46' of the frame 30'. The T-shaped slot 82' receives a T-shaped flange 84' connected to a stationary member 86' that is preferably affixed to the heel portion 24' of the boot 22' by conventional fastening techniques such as rivets. The T-shaped flange 84' slides within the T-shaped slot 80' to allow the heel portion 24' of the boot 22' to slide with respect to the second portion 46' of the frame 30'.

It will be appreciated that the slide track mechanism 80' can be equipped with a locking pin. 47' that engages the T-shaped flange 84' and the frame 30' to prevent the slide track mechanism 80' from sliding. By preventing the slide track mechanism 80' from sliding, the flexible skate 20' is converted into a rigid skate.

FIG. 7 shows the skate 20' flexed in a compressed position such that a slot 36' of the boot 22' is compressed and the heel portion 24' is pivoted generally upward with respect to the toe portion 26' of the boot 22'. Such flexible motion is made possible through the cooperation of the hinge 38' and slot 36' of the boot 22', the pivot pins 63' connecting the first and second portions 44' and 46' of the frame 30' and the sliding connection between the heel portion 24' and the second portion 46' of the frame 30'. When the skate 20' is compressed, the slot narrows, the first and second portions 44' and 46' of the frame 30' pivot with respect to each other and the second portion 46' of the frame 30' slides relative to the heel portion 24' of the boot 22' in a direction generally toward the toe portion 26' of the boot 22'.

FIG. 8 shows the skate 20' flexed in a hyper-extended position. As the skate is flexed from the non-flexed position towards the hyper extended position, the slot 30' in the boot 22' expands, the living hinge 38' in the boot 22' flexes, the first and second portions 44' and 46' of the frame 30' pivot with respect to each other, and the second portion 46' of the frame 30' slides relative to the heel portion 24' of the boot 22' in a direction generally away from the toe portion 26' of the boot 22'.

It will be appreciated that the principles of the present invention may be incorporated within a variety of different skates such as conventional roller skates or even ice skates. In the case of ice skates, the frame of the skate would comprise a conventional ice skate blade. It will also be appreciated that the boot does not necessarily require a slot for flexing. For example, the boot may be constructed of an inherent flexible or soft material. It will further be appreciated that although it is preferred, the frame does not need to be pivoted. For example, the heel or toe portions of the boot could be detachable from the frame to allow the skate to flex.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is as follows:

1. A skate comprising:

a boot having a heel portion and a toe portion, the boot being constructed and arranged to allow for pivotal movement between the heel portion and the toe portion; and a frame including a first portion fastened to the toe portion of the boot and a second portion fastened to the heel portion of the boot, the frame also including pivot structure for allowing the first and second portions of the frame to pivot relative to each other in response to pivotal movement between the heel portion and the toe portion of the boot.

2. The skate of claim 1, wherein the pivot structure includes a pivot member connecting the first and second portions of the frame, the pivot member being slidingly received within a curved slot defined by one of the first and second portions of the frame such that the pivot member slides within the slot to allow the first and second portions of the frame to pivot relative to each other.

3. The skate of claim 1, wherein the pivot structure includes a pivot member pivotally connecting the first and second portions of the frame, and a slide mechanism for allowing the second portion of the frame to slide with respect to the heel portion of the boot.

4. An in-line-skate comprising:

a boot having a toe portion, a heal portion and a base, the boot also including a first pivot structure between the heel portion and the toe portion of the boot;

a frame connected to the base of the boot, the frame including a first portion fastened to the toe portion of the boot and a second portion fastened to the heel portion of the boot, the frame including a second pivot structure for allowing the first and second portions of the frame to pivot relative to each other, wherein the first and second pivot structures cooperate to allow the heel and the toe portions of the boot to flex relative to each other; and first and second sets of tandemly arranged wheels, the first set of wheels being rotatedly connected to the first portion of the frame and the second set of wheels being connected to the second portion of the frame, wherein the first and second sets of wheels pivot relative to each other when the boot flexes.

5. The skate of claim 4, wherein the second pivot structure includes a pivot member connecting the first and second portions of the frame, the pivot member being slidingly received within a curved slot defined by one of the first and second portions of the frame such that the pivot member slides within the slot to allow the first and second portions of the frame to pivot relative to each other.

6. The skate of claim 4, wherein the second pivot structure includes a pivot member pivotally connecting the first and second portions of the frame, and a slide mechanism for allowing the second portion of the frame to slide with respect to the heel portion of the boot.

7. An in-line-skate comprising:

a boot;

a frame connected to the boot;

a single row of tandemly arranged wheels, the wheels being rotatedly connected to the frame; and pivot structure constructed and arranged for allowing the boot to flex at a predetermined location adapted to be in alignment with a wearer's metatarso-phalangeal articulations.

8. The in-line-skate of claim 7, wherein the frame includes first and second portions, and the pivot structure includes a pivot member connecting the first and second portions of the frame, the pivot member being slidingly received within a curved slot defined by one of the first and second portions of the frame.

9. The in-line-skate of claim 7, further comprising a spring structure for biasing the boot toward an unflexed orientation.

10. The in-line-skate of claim 7, further comprising an ankle joint defined by the boot.

* * * * *